US006895879B1

(12) United States Patent
Kronenberger

(10) Patent No.: US 6,895,879 B1
(45) Date of Patent: May 24, 2005

(54) BOBBIN CASE ASSEMBLY WITH THREAD TENSIONING ASSEMBLY

(76) Inventor: Ronald Kronenberger, 320 Portwine Rd., Riverwoods, IL (US) 60015

( * ) Notice: Subject to any disclaimer, the term of this patent is extended or adjusted under 35 U.S.C. 154(b) by 0 days.

(21) Appl. No.: 10/696,322

(22) Filed: Oct. 29, 2003

(51) Int. Cl.[7] ..... D05B 63/00
(52) U.S. Cl. ..... 112/229
(58) Field of Search ..... 112/231, 228, 112/229, 230, 185, 188, 189, 196

(56) References Cited

U.S. PATENT DOCUMENTS 3,381,642 A * 5/1968 Bono ..... 112/229
3,940,089 A * 2/1976 Lindquist ..... 242/156
4,235,178 A * 11/1980 Ackermann ..... 112/229
4,478,162 A * 10/1984 Bierweller ..... 112/227
4,884,519 A * 12/1989 Dreier ..... 112/229
5,433,159 A * 7/1995 Muramatsu ..... 112/184

* cited by examiner

*Primary Examiner*—Ismael Izaguirre
(74) *Attorney, Agent, or Firm*—Wood, Phillips, Katz, Clark & Mortimer

(57) ABSTRACT

A bobbin case assembly having a wall structure mountable operably upon a support and defining a first receptacle for a supply of thread, and a tensioning assembly. The tensioning assembly has a first surface that bears against the thread. At least one of the wall structure and tensioning assembly has a second surface. The thread resides between the first and second surfaces through which the frictional force on the thread is generated. A body is bendable to so that one of the first and second surfaces is movable selectively towards and away from the other. A flexing portion on the body is bendable relative to mounting portion and has first and second flexing regions. The second flexing region is more flexible relative to the first flexing region than the first flexing region is flexible relative to the mounting portion. The first surface is on the second flexing region.

32 Claims, 9 Drawing Sheets

BOBBIN CASE ASSEMBLY WITH THREAD TENSIONING ASSEMBLY

BACKGROUND OF THE INVENTION

1. Field of the Invention

This invention relates to stitching systems utilizing a bobbin case assembly from which a stored supply of thread is drawn and, more particularly, to a bobbin case assembly having an associated thread tensioning assembly which produces a controlled resistance to payout of thread from a supply thereof.

2. Background Art

In sewing/stitching operations, and particularly in embroidery operations, the tension of two source components forming the lockstitch needle thread and bobbin thread must balance to achieve a high quality stitch. If the tension in the needle thread is significantly greater than the bobbin thread tension, the bobbin thread can be pulled through from the underside of the fabric and show at the top side of the fabric being sewn. This condition can cause puckering of the fabric or disfigured sewing to occur. If the needle thread tension is significantly less than the bobbin thread tension, loops can form on either side of the fabric and the stitching formation can appear loose or distortedly large.

A primary job of a sewing equipment operator is to keep bobbin and needle thread tensions as close as possible to balanced. This method of balancing thread tension has historically been carried out by having the sewing equipment operator observe the pattern after stitches are laid down. Good sewing equipment operators constantly adjust the tension of both needle and bobbin threads to maintain a proper balance. Less skilled operators may not consistently maintain this balance as a result of which poor quality stitching formation may result.

In FIGS. 1 and 2 herein, a conventional sewing/stitching system is shown at 10. The sewing/stitching system 10 consists of a bobbin case assembly at 12 that is operably mounted upon a support 14. The bobbin case assembly 12 consists of a bobbin basket assembly 16, which has a bottom wall 18 and an annular, peripheral wall 20 extending upwardly therefrom, and defining in conjunction therewith, a receptacle 22 for a bobbin 24. The bobbin 24 consists of a cylindrical core 26 having a central axis 28. Disk-shaped flanges 30, 32 are connected to the core 26 at the axial ends thereof, and define in conjunction therewith, a thread storage space 33. A supply of thread 34 is wrapped around the core 26 between the flanges 30, 32. A mounting post 36 projects upwardly from the bottom wall 18 and extends through the bobbin 24 so as to support the bobbin 24 for rotation around the axis 28. The mounting post 36 extends fully through the bobbin 24 and has an exposed portion 38, to which a bobbin case 40 is releasably connected.

The bobbin case 40 and bobbin basket assembly 16 cooperatively define a wall structure 42 that captively maintains the bobbin 24 in an operative position relative to the support 14. Through this arrangement, the bobbin 24 is allowed to rotate relative to the wall structure 42 and support 14 around the axis 28.

The thread 34 is directed through the wall structure 42 to be engaged by a thread drawing mechanism 44. The drawn thread is manipulated by one or more stitching components 46 through which the thread 34 is sewn or stitched in any conventional manner with which those skilled in the art are familiar.

The bobbin case 40 has a peripheral wall 47 which surrounds the peripheral wall 20 on the bobbin basket assembly 16. The thread 34 may extend from the supply through one or both of the peripheral walls 20, 47 to be engaged by the thread drawing mechanism 44. In this embodiment, the peripheral wall 47 has a thread receiving opening 50 formed therethrough. A slot 52 extends through the peripheral wall 47 from one axial end thereof in an L shape up to the thread receiving opening 50.

A thread tensioning assembly at 54 is provided on the peripheral wall 47 and is in the form of a spring element 60 that is curved to nominally match the curvature of the outside surface 62 of the peripheral wall 47. The spring element 60 is maintained on the peripheral wall 47 by a screw fastener 64. The curved spring element 60 overlies all, or part, of the thread receiving opening 50, and a portion of the slot 52. The spring element 60 has an elongate body 66 with a mounting portion 68 that is fixed to the peripheral wall 47 through the screw fastener 64. The free end 70 of the body 66, remote from the mounting portion 68, has an offset finger 72 which projects into an opening 74, and interacts with an edge 78, bounding the opening 74, in such a manner that the free end 70 is confined against axial shifting relative to the peripheral wall 47. A second offset finger 80 on the spring element 60 projects into a slot 82 in the peripheral wall 47, likewise to consistently locate the spring element 60 by preventing axial shifting thereof relative to the peripheral wall 47.

Thread 34 departing from the supply on the bobbin 24 and projecting through the thread receiving opening 50, resides between the spring element 60 and the outside surface 62 of the peripheral wall 47. A captive frictional force can be generated on the thread 34 between the radial inwardly facing surface 84 on the spring element 60 and the outside surface 62 of the peripheral wall 47. The captive pressure applied on the thread 34 can be varied by repositioning a flexing portion 86 of the body 66 relative to the mounting portion 68 of the body 66 through an adjustment screw 88. The user sets the adjustment screw 88 to select a desired frictional resistance force between the thread 34 and surfaces 62, 84 to set a "draw tension" for the bobbin case assembly 12.

Typically, the spring element body 66 is made from a thin piece of spring metal which has a uniform thickness. By turning the adjustment screw 88, the inwardly facing surface 84 on the spring element 60 is selectively moved towards the outside surface 62 of the peripheral wall 47 and allowed to move away therefrom, whereby the frictional resistance force on the thread 34 is varied. The amount of friction, and thus the resulting draw tension, is generally determined on a trial-and-error basis. That is, the user roughly sets the adjustment screw 88 to set a thread draw tension, estimated to be at least within a reasonable range of a desired thread draw tension, and then pulls on the thread 34 while holding the bobbin case assembly 12, or thrusts the bobbin case assembly 12 while holding the thread 34. By these procedures, the user can roughly ascertain whether the desired draw tension has been set to within that reasonable range of the desired thread draw tension. Appropriate fine adjustment can thereafter be attempted through manipulation of the adjustment screw 88, with a repetition of the same trial-and-error procedure.

Given the nature of the spring element 60, and its uniform thickness, the bending characteristics of the flexing portion 86 are substantially the same over the entire length of the flexing portion 86. The nature of the spring element 60 and the adjusting structure, i.e. the adjustment screw 88, are such that generally only a relatively gross adjustment in draw tension can be set by the system operator. The spring element 60 has been conventionally made with a construction that is sufficiently stiff that it does not lend itself to fine adjustments that would allow selection of very specific draw tensions that may be desirable for a balanced system capable of producing high quality stitching.

Regardless of skill level, a system operator will generally be incapable of initially setting a desired draw tension or tensions with any predictability. The system operator, by turning the adjustment screw 88, is capable of changing the state of the spring element 60 from one wherein virtually no frictional force is generated upon the departing thread 34, and one wherein the thread 34 becomes locked between the surfaces 62, 84. All settings in between, made through trial and error, may be difficult to select given that a relatively small change in position of the adjustment screw 88 may produce a relatively large change in the thread draw tension. As such, the system operator is relegated to using potentially time consuming and frustrating trial-and-error techniques in attempting to set all draw tensions within the permitted range.

The assignee herein devised an alternative tensioning system, which is the subject of U.S. Pat. No. 6,152,057, which is incorporated herein by reference. In U.S. Pat. No. 6,152,057, an elongate tensioning element is incorporated and has a cylindrical surface against which thread bears to produce a frictional force. By varying the contact area between the thread and tensioning element, different draw tensions can be set for the system. The system lends itself to wrapping of the thread around the tensioning element, with the degree of wrapping dictating the frictional resistance force between the thread and tensioning element. The structure disclosed in U.S. Pat. No. 6,152,057 does offer significant advantages compared to the prior art system described above with respect to FIGS. 1 and 2 herein.

In high volume sewing operations, there may be a large number of bobbin case assemblies which require setup on a one-by-one basis and periodic adjustments as these systems are operated. Thus, minimizing adjusting time and simplifying adjustment procedures are key to economical operation of such sewing operations. The industry continues to seek out ways to predictably select draw tensions, at or close to desired values, without complicated setup procedures or excessive adjustment as the system is monitored both at startup and during use.

SUMMARY OF THE INVENTION

In one form, the invention is directed to a bobbin case assembly having a wall structure mountable operably upon a support and defining a first receptacle within which a supply of thread is stored, and a tensioning assembly for exerting a frictional force on the thread extending away from the receptacle to thereby resist drawing of the thread out of the receptacle. The tensioning assembly has a first surface that bears against the thread extending away from the receptacle. At least one of the wall structure and tensioning assembly has a second surface. The thread extending away from the receptacle resides between the first and second surfaces so that the frictional force on the thread is generated between the first and second surfaces. At least one of the first and second surfaces is defined by a body that is bendable to thereby allow one of the first and second surfaces to be moved selectively towards and away from the other of the first and second surfaces. The body has a mounting portion and a flexing portion which projects away from the mounting portion. The flexing portion is bendable relative to the mounting portion and has a first flexing region and a second flexing region. The second flexing region is more flexible in bending relative to the first flexing region than the first flexing region is flexible in bending relative to the mounting portion. The first surface is defined on the second flexing region.

In one form, the first and second flexing regions are connected by a hinge portion.

In one form, the body has a length and the first and second flexing regions are spaced from each other lengthwise of the body.

The body has a cross-sectional area as viewed in a plane extending transversely to the length of the body. The cross-sectional area of the hinge portion may be locally reduced.

In one form, the first and second flexing regions are spaced from each other lengthwise of the body. The cross-sectional area of at least a part of the second flexing region is less than the cross-sectional area of at least a part of the first flexing region to allow a two-stage flexing of the body as the first surface bears against the thread.

The tensioning element may be selectively adjustable to set and maintain a plurality of different magnitudes of frictional force on the thread extending away from the receptacle.

The tensioning assembly may be selectively adjustable through a threaded fastener.

In one form, the wall structure has a peripheral wall which defines the second surface.

The thread may project from the receptacle through the peripheral wall.

In one form, the body has a flat surface with oppositely facing surfaces and one of the oppositely facing surfaces defines the first surface.

In one form, the wall structure has a peripheral wall with a curved shape and the body is shaped to at least nominally match the curved shape of the peripheral wall.

The bobbin case assembly may be provided in combination with a thread drawing mechanism for engaging and drawing the thread from the receptacle.

The combination may further include at least one component for generating stitching using thread drawn from the receptacle by the thread drawing mechanism.

The invention is further directed to the combination of a bobbin case assembly and first and second tensioning assemblies. The bobbin case assembly has a wall structure mountable operably upon a support and defining a receptacle within which a supply of thread is stored. The first thread tensioning assembly has a first body for exerting a two-stage frictional force on the thread extending away from the receptacle to thereby resist drawing of the thread out of the receptacle. The second tensioning assembly has a second body for exerting a two-stage frictional force on thread extending away from the receptacle to thereby resist drawing of the thread out of the receptacle. The first and second tensioning assemblies have different frictional force generating characteristics. The first and second tensioning assemblies are interchangeably operatively mountable on the wall structure to allow selection of desired force generating characteristics.

In one form, the first body is made from a first material and the second body is made from a second material, with the difference in the first and second materials accounting for different frictional force generating characteristics with the first and second tensioning assemblies operatively mounted on the wall structure.

In one form, the first and second bodies have different dimensions that account for different frictional force generating characteristics with the first and second tensioning assemblies operatively mounted on the wall structure.

In another form, the first and second bodies have different configurations that account for different frictional force generating characteristics with the first and second tensioning assemblies operatively mounted on the wall structure.

In one form, the first body has a first mounting portion and a first flexing portion which projects away from the first mounting portion. The first flexing portion is bendable relative to the first mounting portion and has a first flexing region and a second flexing region. The second flexing region is more flexible in bending relative to the first flexing region than the first flexing region is flexible in bending relative to the first mounting portion.

The first and second flexing regions may be connected by a hinge portion.

In one form, the first body has a length and the first and second flexing regions are spaced from each other lengthwise of the body.

The combination may further include a support to which the wall structure is operably mounted.

The combination may still further include a thread drawing mechanism for engaging and drawing the thread out of the receptacle.

The combination may further include at least one component for generating stitching using the thread drawn from the receptacle by the thread drawing mechanism.

The invention is further directed to the combination of a wall structure, a body mounted operatively on the wall structure, and first and second adjusting elements. The wall structure is mountable operably upon a support and defines a first receptacle within which a supply of thread is stored. The body has a surface for generating a frictional resistance force on thread projecting from the supply in the receptacle. The first adjusting element is operable to reposition at least a part of the body relative to the wall to thereby vary a frictional resistance force generated by the body on the thread and has a first adjusting capability. The second adjusting element is operable to reposition at least a part of the body relative to the wall to thereby vary a frictional resistance force generated by the body on the thread and has a second adjusting capability that is different than the first adjusting capability. The first and second adjusting elements are selectively interchangeably useable to thereby allow a user to select a desired adjusting capability with respect to a frictional resistance force generated by the body on the thread.

In one form, the first and second adjusting elements are first and second threaded adjustment screws, respectively. Each adjustment screw has a thread length. The thread length of the first adjustment screw is different than the thread length of the second adjustment screw to account for the different adjusting capabilities of the first and second adjusting elements.

The wall structure has an outside wall surface. In one form, the first and second adjusting elements each have a fully tightened state. The surface of the body is spaced further from the outside wall surface with the first adjusting element in its fully tightened state than with the second adjusting element in its fully tightened state to thereby account for the different adjusting capabilities of the first and second adjusting elements.

DETAILED DESCRIPTION OF THE DRAWINGS

Figure 1:
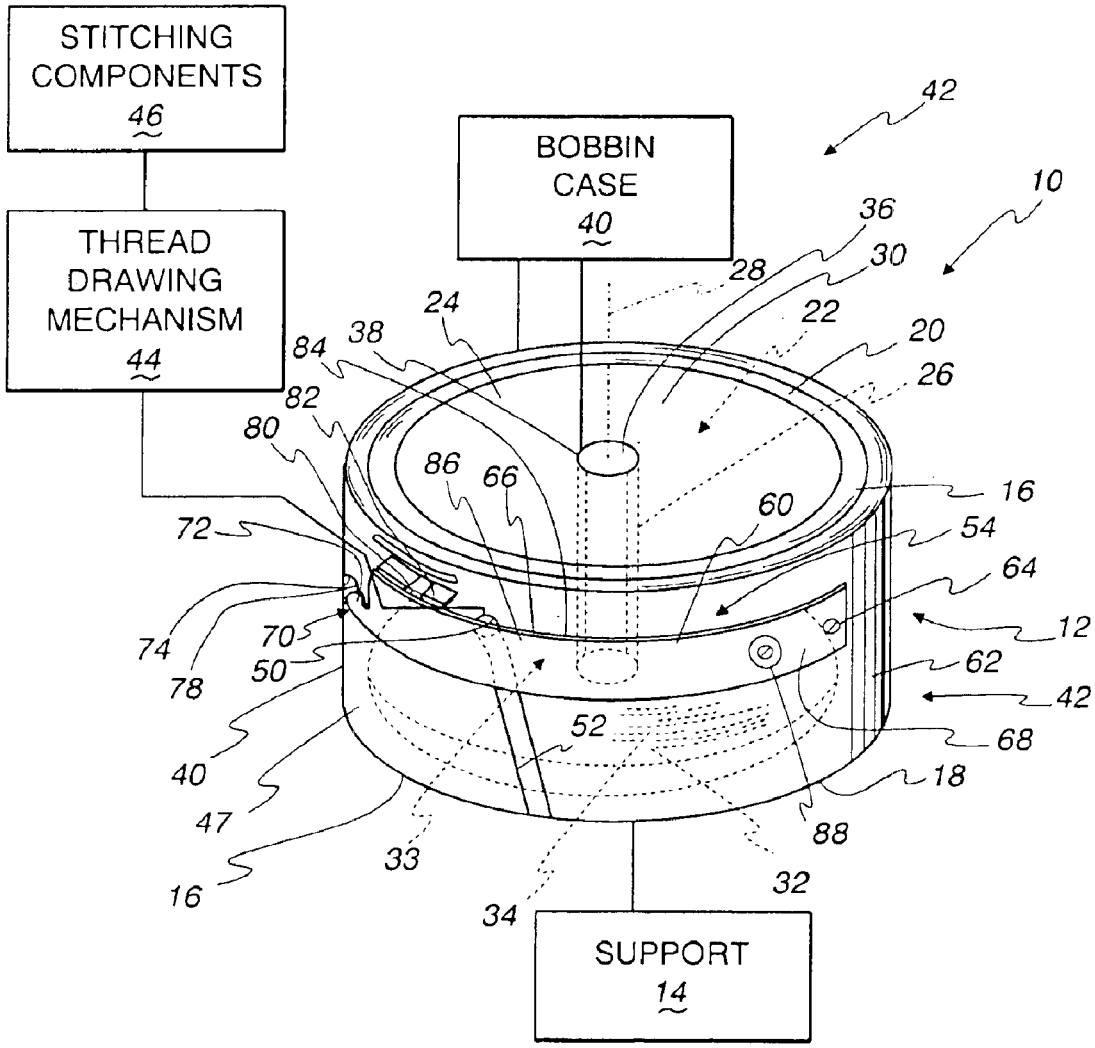
Fig.1 (PRIOR ART)
FIG. 1 is a partially schematic representation of a conventional sewing/stitching system incorporating a bobbin case assembly, shown in perspective, and incorporating a thread tensioning assembly.
Figure 2:
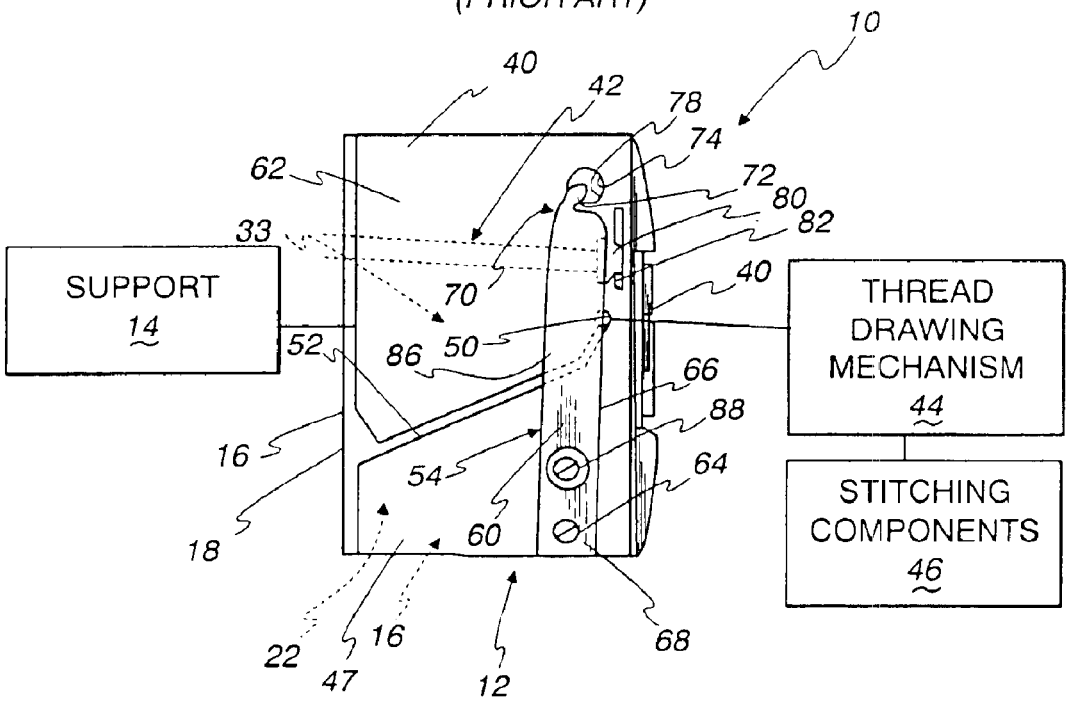
Fig. 2 (PRIOR ART)
FIG. 2 is a view as in FIG. 1 with the bobbin case assembly viewed in front elevation.

The present invention is directed to an improvement in the thread tensioning assembly 54, previously described with respect to FIGS. 1 and 2. As will be described in greater detail below, the inventive thread tensioning assemblies are intended to be incorporated into a conventional bobbin case assembly 12, as shown in the sewing/stitching system 10 in FIGS. 1 and 2, and into virtually any other configuration of bobbin case assembly in which a thread drawing mechanism 44 is incorporated and draw tension on the thread is required to be controlled as the sewing/stitching system 10 is operated.

Figure 3:
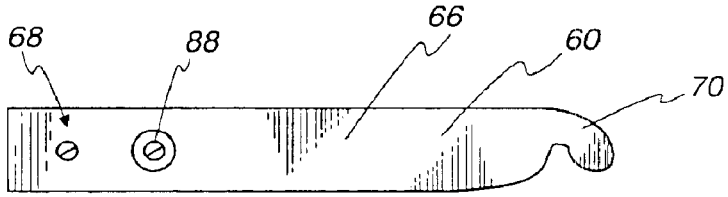
Fig. 3 (PRIOR ART)
FIG. 3 is a front elevation view of a tensioning element on the thread tensioning assembly in FIGS. 1 and 2.
Figure 4:
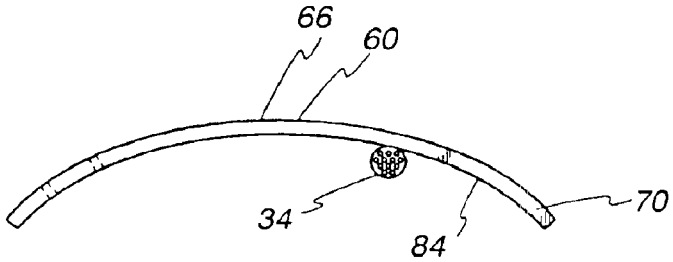
Fig. 4 (PRIOR ART)
FIG. 4 is a plan view of the tensioning element in FIG. 3 adjusted to a low, or no, tension state.
Figure 5:
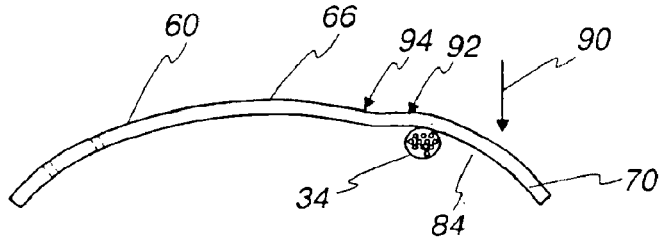
Fig. 5 (PRIOR ART)
FIG. 5 is a view as in FIG. 4 wherein the tensioning element is adjusted to create a greater tension on thread than would occur with the tensioning element in the FIG. 4 state.

In FIGS. 3–5, the aforementioned, conventional spring element 60 is depicted. The body 66 of the spring element is made from sheet spring steel stock, with a uniform thickness. In FIG. 4, the spring element 60 is depicted in a state wherein the adjusting screw 88 is loosened to the point that there is a minimal, if any, frictional force between the thread 34 and surface 84. As seen in FIG. 4, by tightening the adjustment screw 88, the free end 70 of the body 66 is urged in the direction of the arrow 90 closer to the peripheral wall surface 62. By doing so, the frictional resistance force developed between the thread 34 and surface 84 is increased. This adjustment causes a modicum of flexing of the body 66 at the region at 92 where the thread 34 contacts the body 66. This bending is shown in an exaggerated form in FIG. 5. What occurs, as the adjusting screw 88 is tightened, is that the unsupported region of the body 94 bows slightly inwardly as the body, between the mounting portion 68 and the thread 34, is urged, through the adjusting screw 88, in the direction of the arrow 90. However, as noted above, given the bending characteristics of the material defining the body 66, the deformation in the region 94 is relatively insignificant. Thus, the adjustments in draw tension are more gross adjustments, attributable primarily to the shifting of the flexing portion 86 of the body 66, relative to the mounting portion 68 towards the peripheral wall surface 62, with there being little "give" that would somewhat diminish the force applied to the thread 34.

Figure 6:
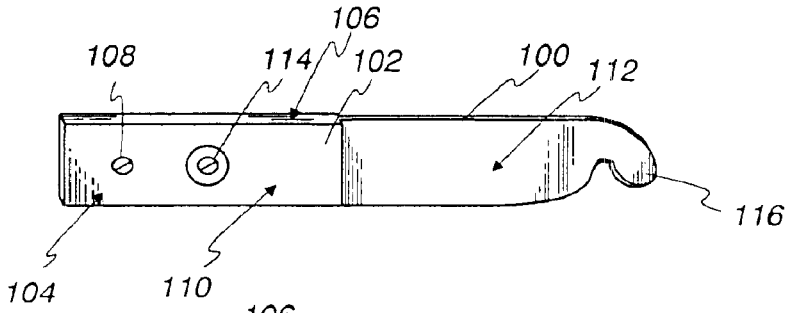
FIG. 6 is a view as in FIG. 3 showing one form of tensioning element, made according to the present invention, and including a body having a mounting portion and first and second flexing regions projecting away from the mounting portion.
Figure 7:
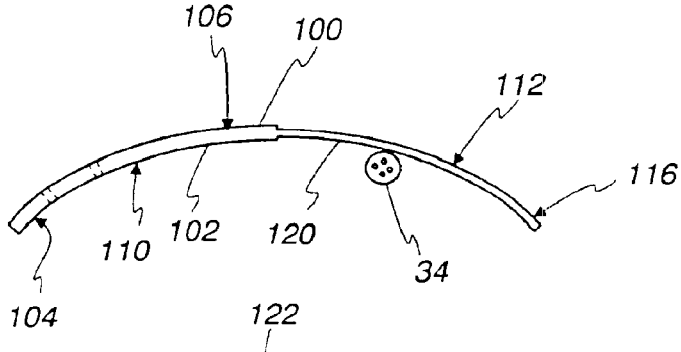
FIG. 7 is a view of the mounting element of FIG. 6 from the same perspective and in the same state as in FIG. 4.
Figure 8:
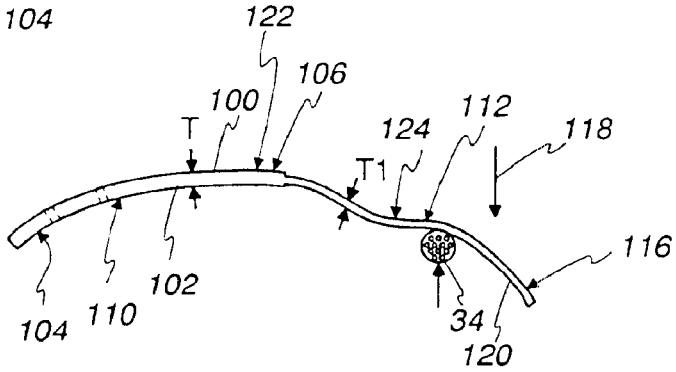
FIG. 8 is a view of the mounting element of FIG. 6 from the same perspective and in the same state as in FIG. 5.

In FIGS. 6–8, one form of tensioning element, that is part of a tensioning assembly, according to the present invention, is shown at 100. The tensioning element 100 has a body 102 having substantially the same shape as the body 66 as viewed from the corresponding perspectives in FIGS. 3 and 6. The body 102 has an elongate configuration with a mounting portion at 104 and a flexing portion 106 which projects away from the mounting portion 104. The mounting portion 104 is fixedly secured to the peripheral wall 20 through a screw fastener 108. The function of the tensioning element 100 corresponds to the function of the previously described, conventional spring element 60.

According to the invention, the flexing portion 106 has first and second flexing regions 110, 112. The second flexing region 112 is more flexible in bending relative to the first flexing region 110 than the first flexing region 110 is flexible in bending relative to the mounting portion 104. In this particular embodiment, the different flexing characteristics at the first and second flexing regions 110, 112 are attributable to different thicknesses T, T1 for the first and second flexing regions 110, 112, respectively.

With this arrangement, as the adjustment screw 114, corresponding to the adjustment screw 88, previously described, is tightened, the free end 116 of the body 102 is urged towards the peripheral wall 47, in the direction of the arrow 118 in FIG. 8, and against the thread 34. The force of the thread 34 against the facing surface 120 of the body 102 causes a two-stage flexing at the first flexing region 110 and the second flexing region 112. It is possible that little or no flexing of the first flexing region 110 may occur, however. As seen in FIG. 8, the force of the surface 120 against the thread 34 causes a slight bending/deflection at the location at 122 in the first flexing region 110 and a more significant bending/deflection at the location at 124 in the second flexing region 112.

Accordingly, as the body 102 is loaded against the thread 34 and peripheral wall 47, as the adjustment screw 114 is progressively tightened, the magnitude of the frictional resistance force between the thread 34 and body 102 is significantly affected by reactive bending of the body 102. A force produced on the thread 34, by urging the body 102 towards the peripheral wall 47, is diminished by reason of the combined effect of the first flexing region 110 deforming/flexing in a first manner and the second flexing region 112 deforming/flexing in a second manner. With this two-stage arrangement, the force that would be imparted to the thread 34, by urging the first flexing region 110 towards the peripheral wall 47 by tightening the adjustment screw 114, may be significantly reduced or tempered by the flexing of the second flexing region 112 relative to the first flexing region 110. Thus, relatively fine adjustments of draw tension are made possible by tightening the adjustment screw 114 in an otherwise conventional arrangement of elements.

Figure 9:
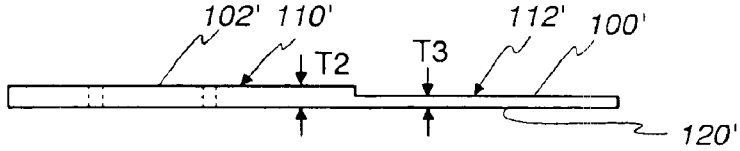
FIG. 9 is a plan view of a modified form of tensioning element, according to the present invention, flattened and having different thicknesses in the first and second flexing regions.

The invention contemplates various different structures for allowing the two-stage flexing. In FIG. 9, a modified form of tensioning element, according to the present invention, is shown at 100'. The tensioning element 100' has a body 102' with a first flexing region 110' and a second flexing region 112'. The first flexing region has a thickness T2, with the second flexing region 112' having a thickness T3 that is less than the thickness T2. In this embodiment, the surface 120', corresponding to the surface 120 on the tensioning element 100, resides entirely in a single plane with the body 102' in a flattened state, as shown in FIG. 9. On the other hand, the tensioning element 100 in FIGS. 6–8 is symmetrical in configuration with respect to a plane that bisects the thickness of the body 102.

Figure 10:
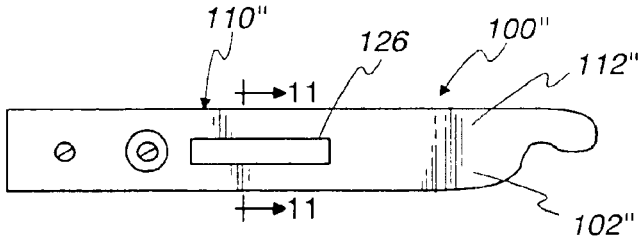
FIG. 10 is a view as in FIG. 6 of a further modified form of tensioning element, according to the present invention, and incorporating a reinforcing rib to form first and second flexing regions.
Figure 11:
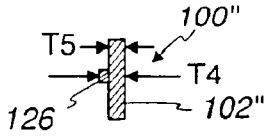
FIG. 11 is a cross-sectional view of the tensioning element taken along line 11—11 of FIG. 10.

In FIGS. 10 and 11, another form of tensioning element is shown at 100" having a body 102". The different flexing characteristics are incorporated into the body 102" by providing a reinforcing rib 126, that locally increases the effective thickness T4 of the body 102" in the corresponding first flexing region 110", compared to the thickness T5 in the corresponding second flexing region 112".

Figure 12:
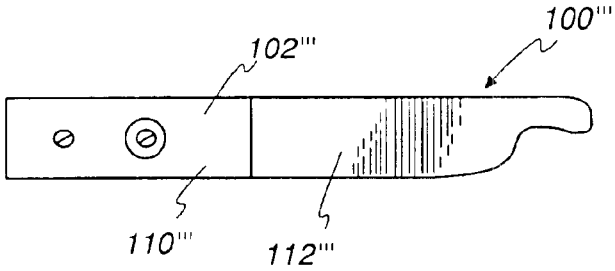
FIG. 12 is a view as in FIG. 10 of a modified form of tensioning element, according to the present invention, wherein the first and second flexing regions are defined by different compositions.

In FIG. 12, another modified form of tensioning element, with two-stage flexing capability, is shown at 100'''. The tensioning element 100''' has a body 102''' with a first flexing region 110''' made from a first material and second flexing region 112''' made from a second material that has different bending characteristics than the first material. The body 102''' may have a uniform or nonuniform thickness, with the latter potentially allowing another dimension of frictional force varying capability.

Figure 13:
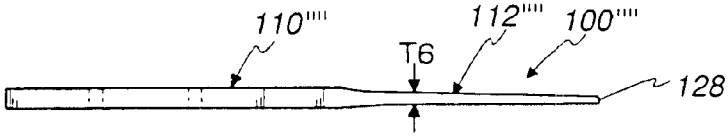
FIG. 13 is a view as in FIG. 9 of a modified form of tensioning element, according to the present invention, wherein the second flexing region has a progressively decreasing thickness from the first flexing region towards a free end.

The invention also contemplates that an additional "stage" of flexing can be incorporated by changing the bending characteristics over the second flexing region. As shown in FIG. 13, a tensioning element 100'''' is shown with a second flexing region 112'''' having a thickness T6 that progressively diminishes going in a direction from the first flexing region 110'''' towards a free end 128.

Figure 14:
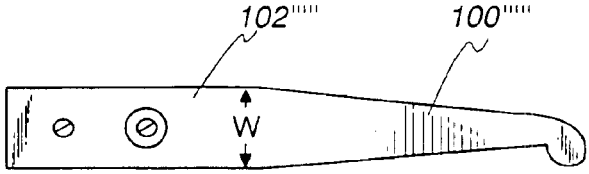
FIG. 14 is a view as in FIG. 12 of a further modified form of tensioning element, according to the present invention, wherein the second flexing region diminishes in width from the first flexing region towards a free end.

The same capability can be incorporated by progressively varying a width W for a body 102''''', shown in a further modified form of tensioning element 100''''' in FIG. 14.

Figure 15:
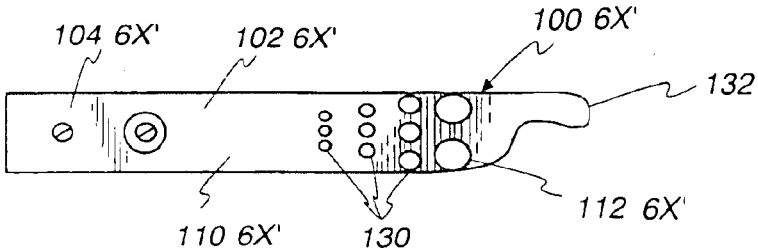
FIG. 15 is a view as in FIG. 14 of a further modified form of tensioning element, according to the present invention, incorporating openings to change the bending characteristics of the second flexing region.

A still further variation of the inventive concept is shown in FIG. 15 for a tensioning element $\mathbf{100}^{6x'}$. The tensioning element $\mathbf{100}^{6x'}$ has a body $\mathbf{102}^{6x'}$ having a first flexing region $\mathbf{110}^{6x'}$ and a second flexing region $\mathbf{112}^{6x'}$. A plurality of openings 130 are formed either partially or fully through the second flexing region $\mathbf{112}^{6x'}$. With the openings 130 increasing in size away from a mounting portion $\mathbf{104}^{6x'}$, the second flexing region $\mathbf{112}^{6x'}$ is progressively more flexible between the first flexing region $\mathbf{102}^{6x'}$ and the free end 132 of the body $\mathbf{102}^{6x'}$. Other arrangements and configurations of the openings 130 are contemplated. As just examples, the openings 130 in each case can have the same shape and diameter or different shapes and different diameters. The openings 130 in each case decrease the cross-sectional area of the body $\mathbf{102}^{6x'}$, as viewed in a plane extending transversely to the length of the body, to thereby change bending characteristics thereat. The cross-sectional area of the body $\mathbf{102}^{6x'}$ on opposite lengthwise sides of the body $\mathbf{102}^{6x'}$ is greater than the cross-sectional area at the openings 130.

Figure 16:
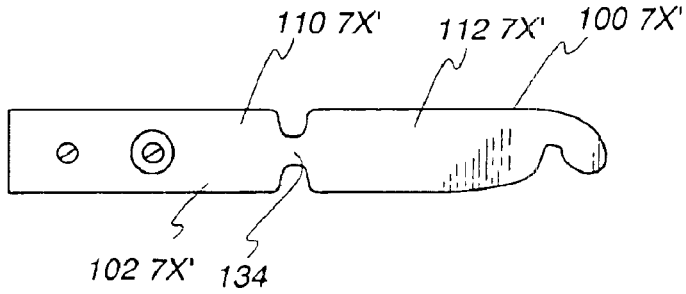
FIG. 16 is a view as in FIG. 15 of a still further modified form of tensioning element, according to the present invention, and incorporating a hinge portion between first and second flexing regions.

The two-stage flexing characteristics can also be incorporated by building a hinge portion into the tensioning element. As shown in FIG. 16, the tensioning element $\mathbf{100}^{7x'}$ has first and second flexing regions $\mathbf{110}^{7x'}$, $\mathbf{112}^{7x'}$ interconnected by a hinge portion 134. The hinge portion 134 has a cross-sectional area, as viewed in a plane extending transversely of the length of the body $\mathbf{102}^{7x'}$, that is less than the corresponding cross-sectional area of the first and second flexing regions $\mathbf{110}^{7x'}$ and $\mathbf{112}^{7x'}$. As a result, the body $\mathbf{102}^{7x'}$ will bend in a predetermined manner at the hinge portion 134. The hinge portion 134 could also be made from a different material than that making up part or all of the remainder of the tensioning element $\mathbf{100}^{7x'}$, with properties that allow selection of a desired bending characteristic.

Figure 17:
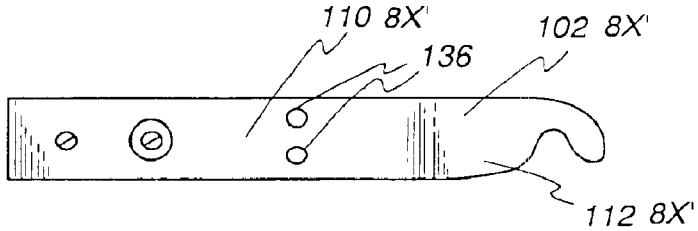
FIG. 17 is a view as in FIG. 16 of a still further modified form of tensioning element, according to the present invention, and including openings which define a modified form of hinge portion.

A like functioning hinge portion can be defined by other means which locally reduces the corresponding cross-sectional area thereat. As shown for example in FIG. 17, openings 136 are provided in the body $\mathbf{112}^{8x'}$ between corresponding first and second flexing regions $\mathbf{110}^{8x'}$ and $\mathbf{112}^{8x'}$. By locally reducing the cross-sectional area through formation of the openings 136, a hinge portion is defined thereat at which the body $\mathbf{102}^{8x'}$ tends to bend more readily than at other regions thereof.

Figure 18:
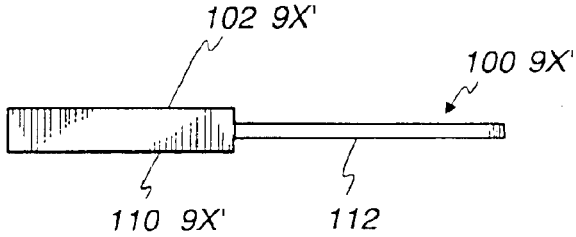
FIG. 18 is a front elevation view of a still further modified form of tensioning element, according to the present invention, and having a stepped cylindrical shape.
Figure 19:
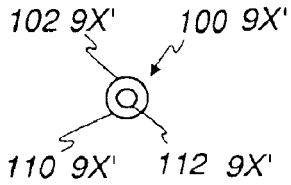
FIG. 19 is an end elevation view of the tensioning element in FIG. 18.

While the tensioning elements 100, 100', 100", 100''', 100'''', 100''''', $\mathbf{100}^{6x'}$, $\mathbf{100}^{7x'}$, $\mathbf{100}^{8x'}$ have been shown to have bodies 102, 102', 102", 102''', 102'''', 102''''', $\mathbf{102}^{6x'}$, $\mathbf{102}^{7x'}$, and $\mathbf{102}^{8x'}$ that are made from a flat sheet stock material, this configuration is not critical. As just one other example, as shown in FIGS. 18 and 19, the tensioning element $\mathbf{100}^{9x'}$ may be made in a generally cylindrical form. In this embodiment, the body $\mathbf{102}^{9x'}$ has first and second flexing regions $\mathbf{110}^{9x'}$, $\mathbf{112}^{9x'}$ with different flexing characteristics to incorporate a two-stage flexing capability. The first flexing region $\mathbf{110}^{9x'}$ has a different/greater diameter than the diameter of the second flexing region $\mathbf{112}^{9x'}$.

Figure 20:
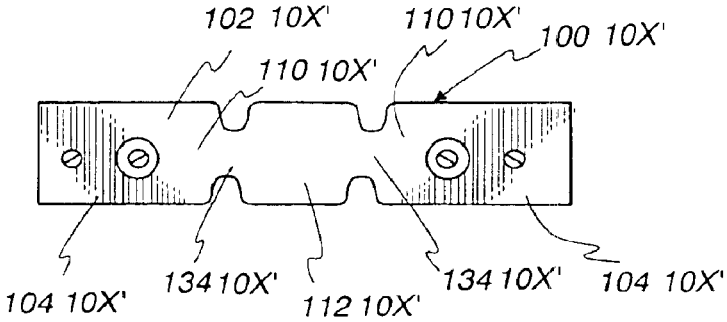
FIG. 20 is a front elevation view of a still further modified form of tensioning element, according to the present invention, and including two mounting portions and two hinge portions each connected to a flexing region.

It is also not necessary that the tensioning element be conventionally mounted through a cantilevered arrangement. As shown in FIG. 20, the tensioning element $\mathbf{100}^{10x'}$ has a body $\mathbf{102}^{10x'}$ with spaced mounting portions $\mathbf{104}^{10x'}$ and corresponding first flexing regions $\mathbf{110}^{10x'}$ projecting away from each mounting portion $\mathbf{104}^{10x'}$. A second flexing region $\mathbf{112}^{10x'}$ connects to each of the first flexing regions $\mathbf{110}^{10x'}$ through hinge portions $\mathbf{134}^{10x'}$.

Figure 21:
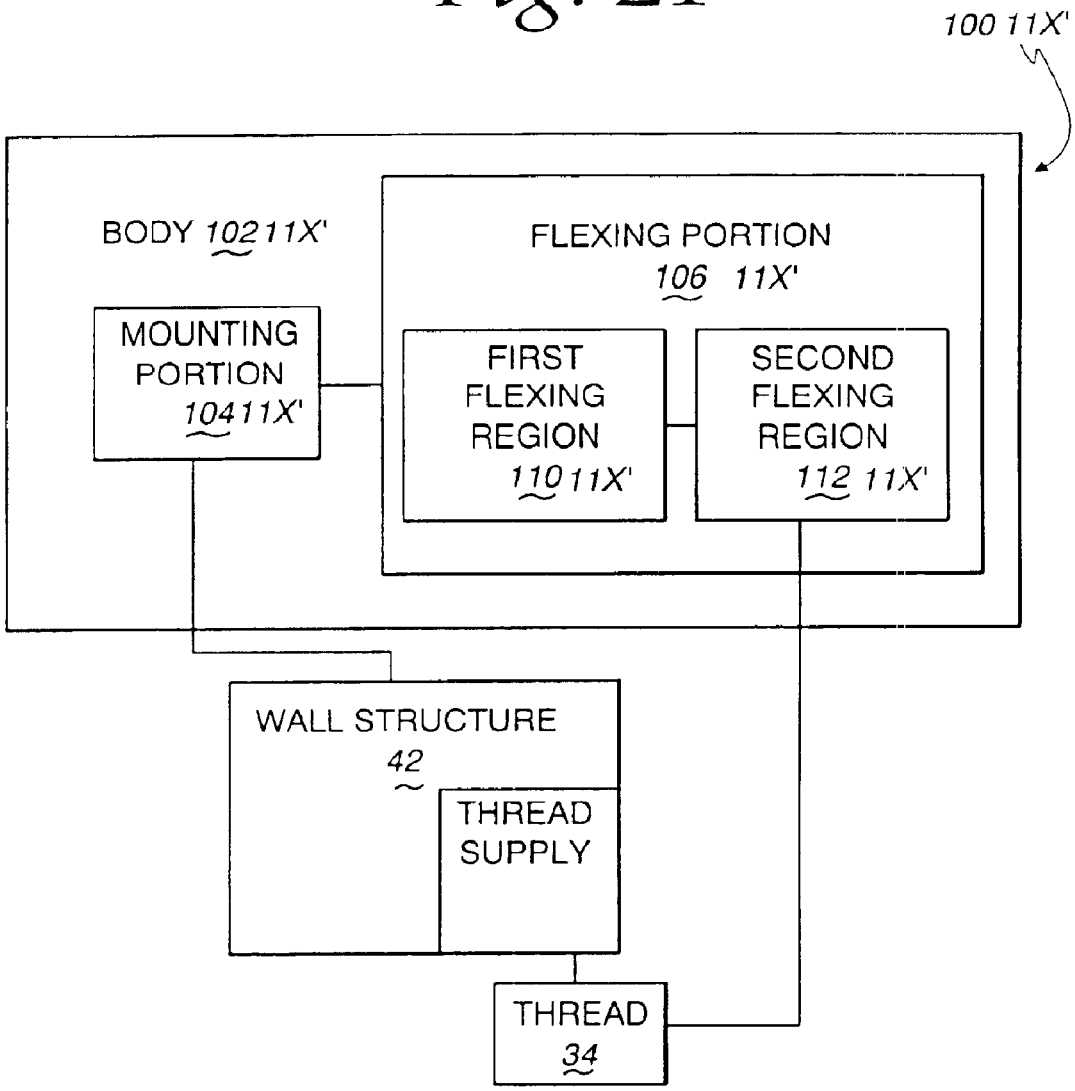
FIG. 21 is a schematic representation of a tensioning element, according to the present invention, attached to a wall structure and representing generically all different variations of tensioning element contemplated by the invention, including, but not limited to, those disclosed herein.

Still other configurations for the tensioning element 100, and manners of mounting the same to the peripheral wall 47, are contemplated by the invention. A broad range of modifications, contemplated by the present invention, are depicted generically in the schematic drawing in FIG. 21 to include structures shown herein, as well as others not shown herein that might be readily derived by those skilled in this art. The tensioning element $\mathbf{100}^{11x'}$, shown in FIG. 21, has a body $\mathbf{102}^{11x'}$ with a mounting portion $\mathbf{104}^{11x'}$ to which a flexing portion $\mathbf{106}^{11x'}$ is connected. The flexing portion $\mathbf{106}^{11x'}$ has first and second flexing regions $\mathbf{110}^{11x'}$ and $\mathbf{112}^{11x'}$, respectively. The tensioning element $\mathbf{100}^{11x'}$ is mounted upon any wall structure 42 in which a supply of thread 34 is contained and from which the thread 34 projects to be engaged at the second flexing region $\mathbf{112}^{11x'}$ to allow a frictional resistance force to be generated.

Figure 22:
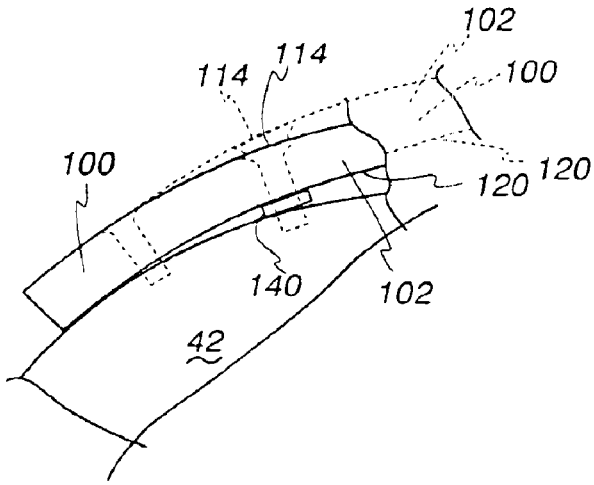
FIG. 22 is an enlarged, fragmentary, plan view of the tensioning element in FIGS. 6–8 operatively mounted upon a wall structure and showing a spacer which allows consistent setting of the frictional characteristics of the tensioning element.

Another aspect of the invention can be seen in FIG. 22 with respect to the exemplary tensioning element 100. In this embodiment, a spacer 140 is provided on the surface 120 of the body 102. The adjustment screw 114 passes through the body 102 and through, or past, the spacer 140. With this arrangement, the tensioning element 100 and spacer 140 can be configured so that maximizing the torque on the adjustment screw 114, to a fully tightened state, does not captively lock the thread 34 through the tensioning element 100, but rather sets a draw tension for the system that can be predetermined. It is also possible to incorporate mechanisms, such as detent-type mechanisms, visible markings, etc., that identify specific draw tension settings that can be consistently arrived at, and potentially predetermined, to facilitate system setup without requiring special skills or significant setup time.

Figure 23:
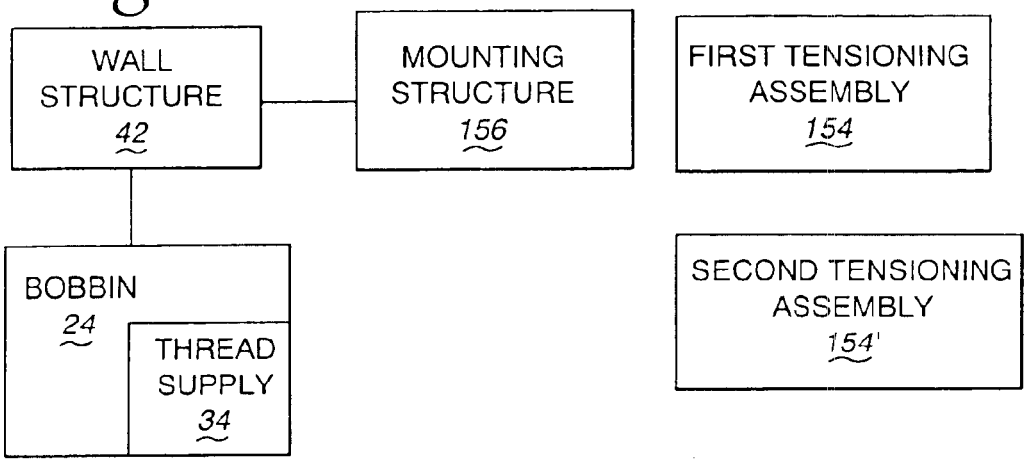
FIG. 23 is a schematic representation of a kit including first and second tensioning assemblies, according to the present invention, that can be selectively interchangeably operatively mounted upon a wall structure in a sewing/stitching system.

The configuration in FIG. 22 lends itself to the provision of a kit, as depicted schematically in FIG. 23. The kit consists of a first tensioning assembly 154, incorporating any of the tensioning elements, previously-described, and a second tensioning assembly 154', that may have any of the aforementioned constructions such that the first and second tensioning assemblies 154, 154' account for different frictional force generating characteristics, i.e. different thread draw tensions, with the first and second tensioning assemblies 154, 154' operatively mounted on the wall structure 42 within which the bobbin 24 carrying the thread supply 37 is located, through any appropriate mounting structure 156. The first and second tensioning assemblies 154, 154' can be interchangeably, operatively mounted. With this arrangement, the tensioning assemblies 154, 154' can be designed to cause different draw tensions to be developed, or a different range of draw tensions to be developed, when operatively attached to the wall structure 42. As noted, the different frictional force generating characteristics can be made different by reason of making the tensioning elements associated with each of the tensioning assemblies 154, 154' different in composition, dimension, shape, etc.

In one form of the invention, the tensioning elements on each of the first and second tensioning assemblies 154, 154' are set or settable to generate one or more predetermined frictional resistance forces resulting in predeterminable draw tensions. A system operator may be made aware of what tensioning assembly 154, 154' is to be selected and installed to produce the desired draw tension or range of draw tensions.

The tensioning assemblies 154, 154' may include the tensioning elements, previously described, to cooperate with the surface 62 of the peripheral wall 20, or alternatively may be self-contained to have two cooperating surfaces between which the thread 34 is captively located. These different structural options are shown in FIGS. 24 and 25.

Figure 24:
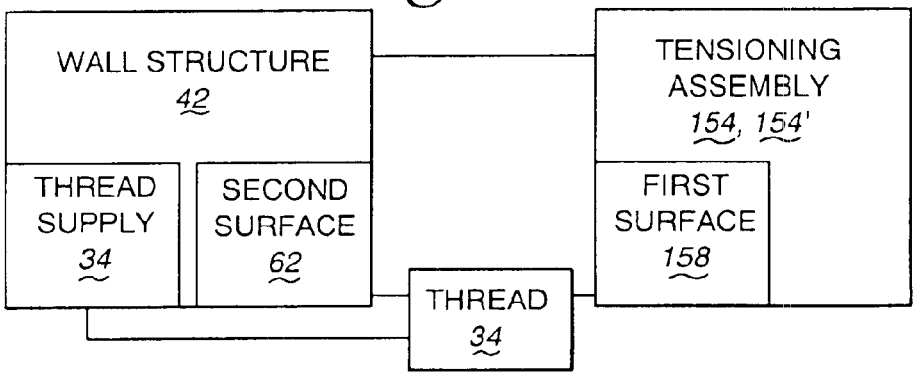
FIG. 24 is a schematic representation of a bobbin case assembly incorporating the inventive tensioning assembly wherein a frictional force on thread is generated between the tensioning assembly and a surface on a wall structure to which the tensioning assembly is attached.

In FIG. 24, the tensioning assembly 154, 154' includes a first surface 158 which acts against a second surface, which is, for example, the outside surface 62 on the wall structure 42. The thread 34 is captive between the first surface 158 and the second surface 62 such that a frictional force is generated therebetween to control draw tension.

Figure 25:
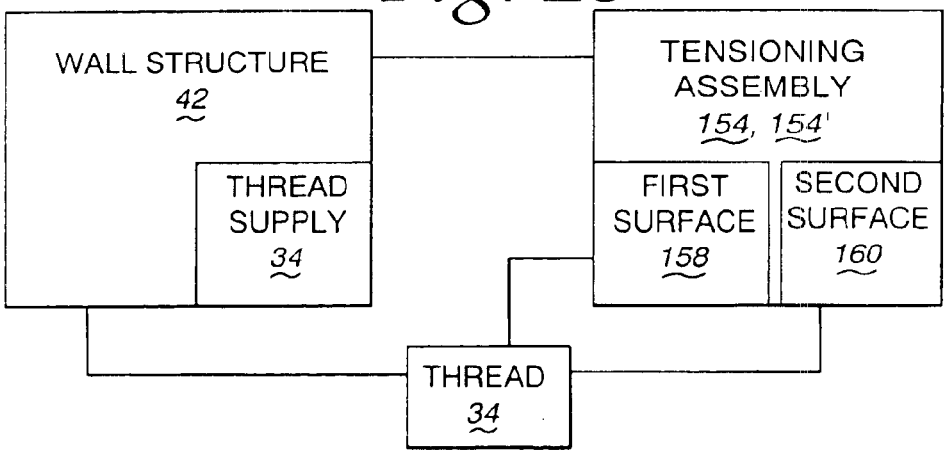
FIG. 25 is a view as in FIG. 24 wherein the tensioning assembly that is attached to the wall structure is a self-contained unit including both surfaces between which the thread is captive to produce a frictional resistance force thereon.

In FIG. 25, the tensioning assembly 154, 154' has a corresponding first surface 158 and a second surface 160 which is assembleable as a self-contained unit to the wall structure 42. The primary difference is that the tensioning assembly 154, 154' shown in FIG. 25 does not require direct interaction with the outside surface 62 of the wall structure 42.

Figure 26:
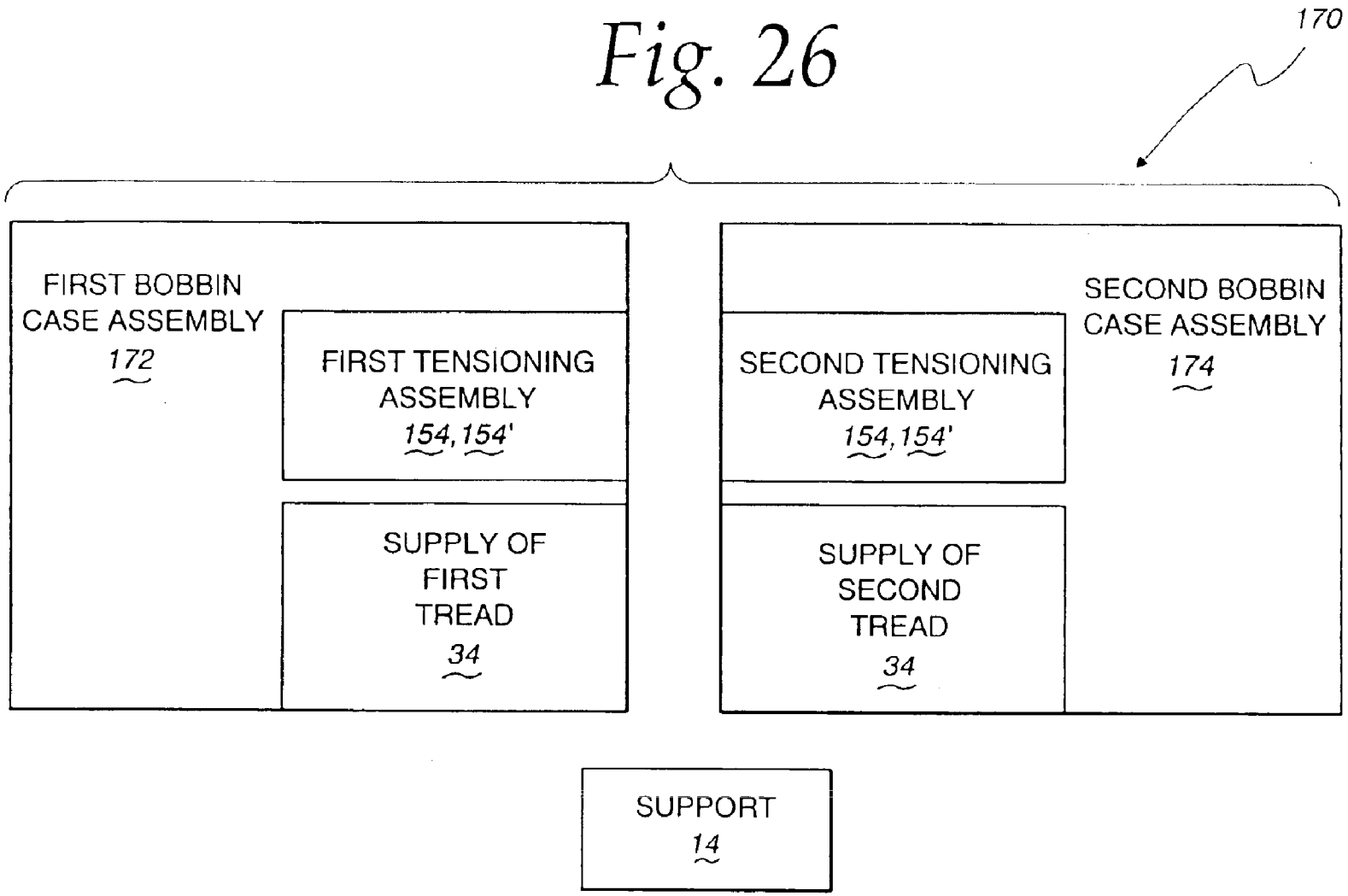
FIG. 26 is a schematic representation of a modified form of kit, according to the present invention, including self-contained bobbin case assemblies incorporating different tensioning assemblies, according to the present invention, which bobbin case assemblies can be interchangeably operably mounted upon a support.

The invention also contemplates selling a kit, as shown at 170 in FIG. 26, including first and second self-contained bobbin case assemblies 172, 174, incorporating first and second tensioning assemblies 154, 154' having different frictional generating characteristics, i.e. capable of producing different draw tensions. This provides an alternative to the kit depicted in FIG. 23, which requires interchangeable installation of first and second tensioning assemblies 154, 154' on the wall structure 52.

Figure 27:
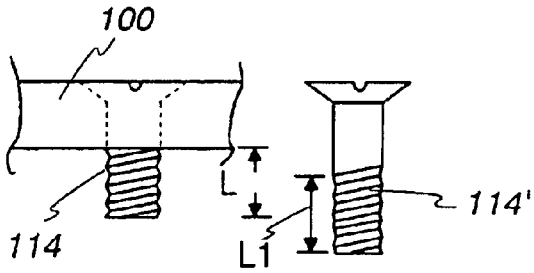
FIG. 27 is an elevation view of a kit, according to the present invention, and including a first threaded fastener with a first threaded length extending through a portion of a tensioning element and a second threaded fastener with a second threaded length that is different than the first threaded length and that is interchangeable with the first threaded fastener to maintain the flexing portion of the tensioning element in different preselected positions.

A still further form of kit, according to the present invention, as shown in FIG. 27, includes interchangeable adjustment screws 114 and 114', with the former, previously described, having a thread length L, and the latter having a greater thread length L1. By tightening each of the adjustment screws to a fully tightened state, the resulting repositioning of the exemplary tensioning element 100, and the surface 120 thereon, is different by reason of the difference in the degree of penetration permitted using the different adjustment screws 114, 114'. That is, the adjustment screw 114' will "bottom out" in its fully tightened state with the surface 120 spaced further from the outside wall surface 62 on the wall structure 42 than the wall surface 120 will be with the screw 114 in its fully tightened state. Other configurations of adjustment screw are contemplated by the invention to accomplish this same end. For example, the use of spacers, or the use of different dimensioned spacers, might allow the desired different thread frictional resistance force adjusting capabilities for the adjustment screws. A non-threaded type of adjusting element could also be adapted to perform the desired function. The particular repositioning that occurs with each can be predetermined and correlated to different draw tensions.

Other variations are contemplated by the invention. As just one example, coatings may be provided on surfaces against which the thread 34 bears, to thereby alter the frictional resistance force thereon.

The foregoing disclosure of specific embodiments is intended to be illustrative of the broad concepts comprehended by the invention.

What is claimed is:

1. A bobbin case assembly comprising:

a wall structure mountable operably upon a support and defining a first receptacle within which a supply of thread is stored, and a tensioning assembly for exerting a frictional force on thread extending away from the receptacle to thereby resist drawing of the thread out of the receptacle, the tensioning assembly comprising a first surface that bears against the thread extending away from the receptacle, at least one of the wall structure and tensioning assembly comprising a second surface, the thread extending away from the receptacle residing between the first and second surfaces so that the frictional force on the thread is generated between the first and second surfaces, at least one of the first and second surfaces defined by a body that is bendable to thereby allow the one of the first and second surfaces to be moved selectively towards and away from the other of the first and second surfaces, the body comprising a mounting portion and a flexing portion which projects away from the mounting portion, the flexing portion bendable relative to the mounting portion and comprising a first flexing region and a second flexing region, the second flexing region more flexible in bending relative to the first flexing region than the first flexing region is flexible in bending relative to the mounting portion, the first surface defined on the second flexing region, wherein the first and second flexing regions are connected by a hinge portion, wherein the body has a length and the first and second flexing regions are spaced from each other lengthwise of the body, wherein the body has a cross-sectional area as viewed in a plane extending transversely to the length of the body and the hinge portion has a cross-sectional area that is less than the cross-sectional area of first and second portions of the body that are spaced from each other lengthwise of the body and between which the hinge portion resides.

2. The bobbin case assembly according to claim 1 wherein the body has a length, the first and second flexing regions are spaced from each other lengthwise of the body, the body has a cross-sectional area as viewed in a plane extending transversely to the length of the body and the cross-sectional area of at least a part of the second flexing region is less than the cross-sectional area of at least a part of the first flexing region to allow a two-stage flexing of the body as the first surface bears against the thread.

3. The bobbin case assembly according to claim 1 wherein the tensioning assembly is selectively adjustable to set and maintain a plurality of different magnitudes of frictional force on the thread extending away from the receptacle.

4. The bobbin case assembly according to claim 3 wherein the tensioning assembly is selectively adjustable through a threaded fastener.

5. The bobbin case assembly according to claim 1 wherein the wall structure has a peripheral wall which defines the second surface.

6. The bobbin case assembly according to claim 5 wherein the thread projects from the receptacle through the peripheral wall.

7. The bobbin case assembly according to claim 1 wherein the body comprises a flat material with oppositely facing surfaces and one of the oppositely facing surfaces defines the first surface.

8. The bobbin case assembly according to claim 7 wherein the wall structure has a peripheral wall with a curved shape and the body is shaped to at least nominally match the curved shape of the peripheral wall.

9. The bobbin case assembly according to claim 1 in combination with a thread drawing mechanism for engaging and drawing thread from the receptacle.

10. The bobbin case assembly according to claim 9 further in combination with at least one component for generating stitching using thread drawn from the receptacle by the thread drawing mechanism.

11. In combination:

a) a bobbin case assembly comprising a wall structure mountable operably upon a support and defining a receptacle within which a supply of thread is stored;

b) a first tensioning assembly having a first body for exerting a two stage frictional force on thread extending away from the receptacle to thereby resist drawing of the thread out of the receptacle; and c) a second tensioning assembly having a second body for exerting a two stage frictional force on thread extending away from the receptacle to thereby resist drawing of the thread out of the receptacle;

the first and second tensioning assemblies having different frictional force generating characteristics;

the first and second tensioning assemblies interchangeably operatively mountable on the wall structure to allow selection of desired force generating characteristics.

12. The combination according to claim 11 wherein the first body comprises a first material and the second body comprises a second material, the difference in the first and second materials accounting for different frictional force generating characteristics with the first and second tensioning assemblies operatively mounted on the wall structure.

13. The combination according to claim 11 wherein the first and second bodies have different dimensions that account for different frictional force generating characteristics with the first and second tensioning assemblies operatively mounted on the wall structure.

14. The combination according to claim 11 wherein the first and second bodies have different configurations that account for different frictional force generating characteristics with the first and second tensioning assemblies operatively mounted on the wall structure.

15. The combination according to claim 11 wherein the first body comprises a first mounting portion and a first flexing portion which projects away from the first mounting portion, the first flexing portion bendable relative to the first mounting portion and comprising a first flexing region and a second flexing region, the second flexing region more flexible in bending relative to the first flexing region than the first flexing region is flexible in bending relative to the first mounting portion.

16. The combination according to claim 15 wherein the first and second flexing regions are connected by a hinge portion.

17. The combination according to claim 16 wherein the first body has a length and the first and second flexing regions are spaced from each other lengthwise of the body.

18. The combination according to claim 11 further comprising a support to which the wall structure is operably mounted.

19. The combination according to claim 18 further comprising a thread drawing mechanism for engaging and drawing thread out of the receptacle.

20. The combination according to claim 19 further in combination with at least one component for generating stitching using thread drawn from the receptacle by the thread drawing mechanism.

21. In combination:

a) a wall structure mountable operably upon a support and defining a first receptacle within which a supply of thread is stored;

b) a body mounted operably on the wall structure and having a surface for generating a frictional resistance force on thread projecting from the supply in the receptacle;

c) a first adjusting element that is operable to reposition at least a part of the body relative to the wall to thereby vary a frictional resistance force generated by the body on the thread and having a first adjusting capability; and d) a second adjusting element that is operable to reposition at least a part of the body relative to the wall to thereby vary a frictional resistance force generated by the body on the thread and having a second adjusting capability that is different than the first adjusting capability;

the first and second adjusting elements selectively interchangeably useable to thereby allow a user to select a desired adjusting capability with respect to a frictional resistance force generated by the body on the thread.

22. The combination according to claim 21 wherein the first and second adjusting elements respectively comprise first and second threaded adjustment screws each with a thread length, and the thread length of the first adjustment screw is different than the thread length of the second adjustment screw to account for the different adjusting capabilities of the first and second adjusting elements.

23. The combination according to claim 21 wherein wall structure has an outside wall surface, the first and second adjusting elements each have a fully tightened state and the surface of the body is spaced further from the outside wall surface with the first adjusting element in its fully tightened state than with the second adjusting element in its fully tightened state to thereby account for the different adjusting capabilities of the first and second adjusting elements.

24. The combination according to claim 23 wherein the first and second adjusting elements respectively comprise first and second threaded adjustment screws.

25. A bobbin case assembly comprising:

a wall structure mountable operably upon a support and defining a first receptacle with a central axis and within which a supply of thread is stored, and a tensioning assembly for exerting a frictional force on thread extending away from the receptacle to thereby resist drawing of the thread out of the receptacle, the tensioning assembly comprising a first surface that bears against the thread extending away from the receptacle, at least one of the wall structure and tensioning assembly comprising a second surface, the thread extending away from the receptacle residing between the first and second surfaces so that the frictional force on the thread is generated between the first and second surfaces, at least one of the first and second surfaces defined by a body that is bendable to thereby allow the one of the first and second surfaces to be moved selectively towards and away from the other of the first and second surfaces, the body having a thickness in a radial direction relative to the central axis, the body comprising a mounting portion and a flexing portion which projects away from the mounting portion, the flexing portion bendable relative to the mounting portion and comprising a first flexing region and a second flexing region, the body having a nonuniform thickness as a result of which at least a portion of the second flexing region is more flexible in bending relative to the first flexing region than the first flexing region is flexible in bending relative to the mounting portion, the first surface defined on the second flexing region.

26. The bobbin case assembly according to claim 25 wherein at least a portion of the second flexing region has a thickness less than the thickness of the first flexing region.

27. The bobbin case assembly according to claim 26 wherein the first flexing region has a first thickness over a majority of the first flexing region, the second flexing region has a second thickness over a majority of the second flexing region, and the second thickness is less than the first thickness.

28. A bobbin case assembly comprising:

a wall structure mountable operably upon a support and defining a first receptacle within which a supply of thread is stored, and a tensioning assembly for exerting a frictional force on thread extending away from the receptacle to thereby resist drawing of the thread out of the receptacle, the tensioning assembly comprising a first surface that bears against the thread extending away from the receptacle, at least one of the wall structure and tensioning assembly comprising a second surface, the thread extending away from the receptacle residing between the first and second surfaces so that the frictional force on the thread is generated between the first and second surfaces, at least one of the first and second surfaces defined by a body that is bendable to thereby allow the one of the first and second surfaces to be moved selectively towards and away from the other of the first and second surfaces, the body comprising a mounting portion and a flexing portion which projects away from the mounting portion, the flexing portion bendable relative to the mounting portion and comprising a first flexing region and a second flexing region, the second flexing region more flexible in bending relative to the first flexing region than the first flexing region is flexible in bending relative to the mounting portion, the first surface defined on the second flexing region, wherein the first and second flexing regions are connected by a discrete hinge portion at which the second flexing region bends in a predetermined manner relative to the first flexing region.

29. The bobbin case assembly according to claim 28 wherein the body has a cross-sectional area as viewed in a plane extending transversely to the length of the body, and the cross-sectional area of the hinge portion is locally reduced.

30. The bobbin case assembly according to claim 28 wherein a second discrete hinge portion is defined on the body.

31. A bobbin case assembly comprising:

a wall structure mountable operably upon a support and defining a first receptacle within which a supply of thread is stored, and a tensioning assembly for exerting a frictional force on thread extending away from the receptacle to thereby resist drawing of the thread out of the receptacle, the tensioning assembly comprising a first surface that bears against the thread extending away from the receptacle, at least one of the wall structure and tensioning assembly comprising a second surface, the thread extending away from the receptacle residing between the first and second surfaces so that the frictional force on the thread is generated between the first and second surfaces, at least one of the first and second surfaces defined by a body that is bendable to thereby allow the one of the first and second surfaces to be moved selectively towards and away from the other of the first and second surfaces, the body comprising a mounting portion and a flexing portion which projects away from the mounting portion, the flexing portion bendable relative to the mounting portion, wherein the body comprises a discrete hinge portion at which the body bends in a predetermined manner to allow the at least one of the first and second surfaces to be moved selectively towards and away from the other of the first and second surfaces.

32. A bobbin case assembly comprising:

a wall structure mountable operably upon a support and defining a first receptacle within which a supply of thread is stored, and a tensioning assembly for exerting a frictional force on thread extending away from the receptacle to thereby resist drawing of the thread out of the receptacle, the tensioning assembly comprising a first surface that bears against the thread extending away from the receptacle, at least one of the wall structure and tensioning assembly comprising a second surface, the thread extending away from the receptacle residing between the first and second surfaces so that the frictional force on the thread is generated between the first and second surfaces, at least one of the first and second surfaces defined by a body that is bendable to thereby allow the one of the first and second surfaces to be moved selectively towards and away from the other of the first and second surfaces, the body comprising a mounting portion and a flexing portion which projects away from the mounting portion, the flexing portion bendable relative to the mounting portion and comprising a first flexing region and a second flexing region, the second flexing region more flexible in bending relative to the first flexing region than the first flexing region is flexible in bending relative to the mounting portion, the first surface defined on the second flexing region, wherein the body has a cross-sectional area as viewed in a plane extending transversely to the length of the body that is other than square or rectangular.

* * * * *